United States Patent [19]

Peterson

[11] 4,039,152

[45] Aug. 2, 1977

[54] GRINDING MILL

[76] Inventor: Rex Peterson, 709 S. University, Provo, Utah 84601

[21] Appl. No.: 635,591

[22] Filed: Nov. 28, 1975

[51] Int. Cl.[2] ..... B02C 7/06; B02C 7/14

[52] U.S. Cl. ..... 241/245; 241/259.1; 241/261.3; 241/296

[58] Field of Search ..... 241/244, 245, 248, 259.1, 241/261.2, 261.3, 296, 298

[56] References Cited

U.S. PATENT DOCUMENTS

| | | | |
|---|---|---|---|
| 1,705,996 | 3/1929 | Pope | 241/259.1 X |
| 2,850,246 | 9/1958 | Rees et al. | 241/244 |
| 2,968,444 | 1/1961 | Jones | 241/261.2 X |
| 3,032,282 | 5/1962 | Asplund | 241/259.1 X |
| 3,040,997 | 6/1962 | Borden | 241/296 X |
| 3,170,649 | 2/1965 | Fisher | 241/259.1 X |
| 3,420,458 | 1/1969 | Paavola | 241/259.1 X |
| 3,482,791 | 12/1969 | Alliegro | 241/296 |
| 3,880,367 | 4/1975 | Grover | 241/296 X |

*Primary Examiner*—Roy Lake
*Assistant Examiner*—Howard N. Goldberg
*Attorney, Agent, or Firm*—Criddle, Thorpe & Western

[57] ABSTRACT

A grinding mill for grinding grain and the like includes a pair of grinding discs, each having a cutting face arranged adjacent to the cutting face of the other disc. Each grinding disc has a plurality of cutting teeth circumferentially spaced on the cutting face to define channels between the teeth. The teeth and the channels of each disc extend inwardly from near the periphery of the disc at an angle to the disc radii so that when one disc is rotated with respect to the other, an outwardly-operating scissor action is effected between the teeth of the two discs. One of the discs is movable axially with respect to the other disc and apparatus is provided for preventing movement of the movable disc to a point where it would otherwise contact the other disc.

19 Claims, 10 Drawing Figures

GRINDING MILL

BACKGROUND OF THE INVENTION

This invention relates to food grinding apparatus and in particular to a grinding mill which grinds or cuts material introduced between a pair of grinding discs.

Grain grinders for use in the home have become popular in recent years partly as a result of an increased interest among consumers of home preparation and cooking of food. The grain grinders most often used for this purpose include rotating and stationary grinding stones between which the grain or other material to be ground is introduced. The rotating stone operates to, in effect, crush the material into finer matter.

The grinding stones typically include flutes or tooth-like grinding ridges extending radially from near the center of the stones to the peripheries thereof. See, for example, U.S. Pat. Nos. 1,985,606, 486,003 and 254,814. One of the problems with this prior art structure has been the heat generated by the grinding operation; this heat tends to adversely affect the material being ground. Additionally, there is the problem of the ground material getting clogged in the cutting ridges and this reduces the efficiency of the grinding operation and therefore the speed at which the material can be ground. Further, if the grinding stones are positioned too close together so that the stones touch at any point of their rotation, then material from the stones will be chipped and integrated with the material being ground and of course this is undesirable. Finally, because of the weight of the stones and the need for an adjustment mechanism to adjust the distance between the stones, it is oftentimes difficult to maintain proper centering of the stones with respect to each other and such difficulty leads to more rapid, uneven wear of both the stones and bearings supporting the stones.

SUMMARY OF THE INVENTION

It is an object of the present invention to provide a grinding mill for grinding cereal grains and the like wherein the material to be ground is cut and ground through a type of scissor action between grinding discs.

It is also an object of the present invention to provide such a grinding mill in which the grinding discs are adapted to effect an outwardly operating scissor action on the material being ground to force the material outwardly as it is being ground.

it is still another object of the present invention, in accordance with one aspect thereof, to provide a grinding mill in which one grinding disc is movable with respect to the other and which includes apparatus for sealing and centering the movable disc.

It is still another object of the present invention, in accordance with another aspect thereof, to provide such a grinding mill with apparatus for preventing the two grinding discs from contacting one another.

The above and other objects of the present invention are realized in an illustrative embodiment thereof which includes a pair of coaxially disposed discs, each having a cutting face arranged in adjacent and opposing relationship with the cutting face of the other disc, each cutting face including a plurality of circumferentially spaced cutting teeth defining channels therebetween. The teeth and channels extend from near the periphery of the discs inwardly at an angle to the radii of the discs so that when one disc is rotated with respect to the other, a type of outwardly-operating scissor action is effected between the teeth to cut material introduced between the discs. Material to be ground is introduced into a central cavity formed between the two discs and is then caused by the rotation of at least one of the discs to move outwardly where it is cut by the teeth.

In accordance with one aspect of the invention, at least one of the discs may be moved axially with respect to the other and structure is provided to prevent the movable disc from being moved closer than a perdeterminable distance from the other disc. In accordance with another aspect of the invention, a support structure is provided for the movable disc and this structure includes an opening into which the movable disc may fit. Centering and sealing apparatus are disposed about the movable disc to appropriately center and seal the movable disc within the opening in the support structure.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
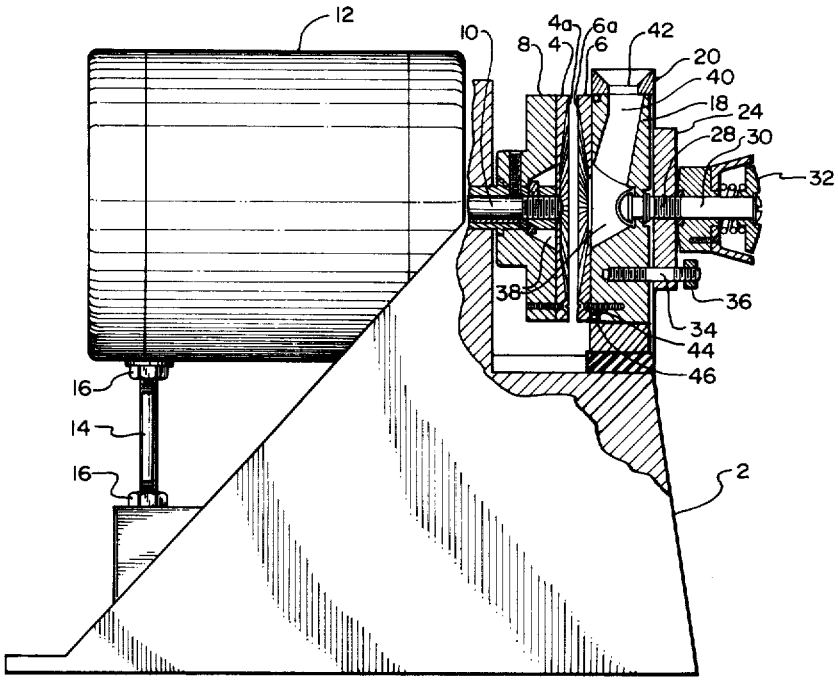
FIG. 1 shows a side elevational, partly cut away cross-sectional view of a grinding mill made in accordance with the principles of the present invention.
Figure 2:
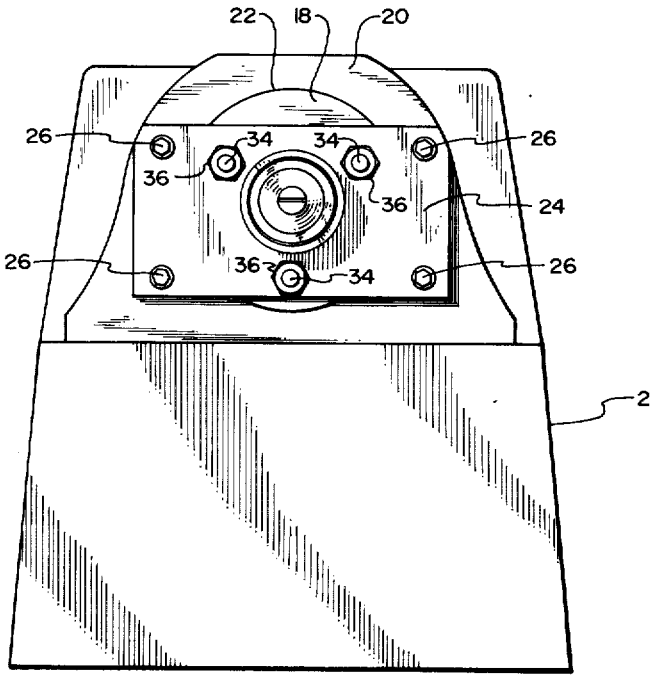
FIG. 2 is a front elevational view of the grinding mill of FIG. 1.

Referring to FIGS. 1 and 2, there is shown a grinding mill having a housing 2 in which is contained the other components of the grinding mill. The grinding mill includes a pair of grinding wheels or discs 4 and 6 arranged coaxially and with cutting faces **4*a* and 6*a* in adjacent and opposing relationship. The grinding disc 4 is mounted on a rotatable support 8 which in turn is mounted on a shaft 10 of a motor 12 so that when the motor 12 is operated, the support 8 is rotated to thereby rotate the grinding disc 4. The motor 12 is mounted in the housing 2 by suitable support structure such as post 14 and nuts 16**.

The grinding disc 6 is mounted on a carrier plate 18 which is arranged to move axially toward and away from the grinding disc 4. A stationary yoke 20 is mounted in the housing 2 to support the carrier plate 18 and grinding disc 6. A circular opening 22 (FIG. 2) is located in the yoke 20 to receive the carrier plate 18 and grinding discs 6 thereinto. A support plate 24 is mounted by bolts 26 on the back of the yoke 20 to extend across a portion of the opening 22. The support plate 24 includes a threaded opening 28 near the center thereof to receive a threaded shaft 30. One end of the shaft 30 is rotatably coupled to the carrying plate 18 so that the shaft 30 may be rotated in the plate 18 but not moved longitudinally with respect thereto. The other end of the shaft 30 is coupled to an adjustment knob 32 so that when the knob is turned, the shaft 30 similarly turns. As the knob 32 and shaft 30 are turned, the threads of the shaft coact with the threaded opening 28 in the support plate 24 to cause the shaft to move longitudinally in the opening 28 and thus cause the carrying plate 18 and grinding disc 6 to move into or out of the opening 22 in the yoke 20. That is, by proper rotation of the knob 32, the disc 6 is moved toward or away from the disc 4.

Threaded openings are located in the carrying plate 18 so that threaded posts 34 may be screwed thereinto. The posts 34, when inserted in the openings in the carrying plate 18, are arranged to extend through openings in the support plate 24 as generally shown in FIG. 1. The end of the posts 34 extending outwardly of the carrying plate 18 are threaded to receive lock nuts 36, as also shown in FIG. 1. By adjustment of the lock nuts 36, the excursion of the carrying plate 18 and grinding disc 6 toward the disc 4 can be fixed. That is, the distance from the disc 4 to within which the disc 6 may be moved can be predetermined by appropriate setting of the lock nuts 36 since the lock nuts would engage the support plate 24 and prevent further movement of the carrying plate 18 as the carrying plate were moved away from the support plate 24. In this manner, the lock nuts 36 can be set to prevent the grinding disc 6 from contacting the grinding disc 4. The advantage of this, of course, is that the user is prevented from inadvertently turning the knob 32 to the point where the grinding disc 6 contacts the rotating disc 4 and thus unnecessary wear or damage to the discs is avoided.

A hollow or cavity 38 is formed centrally in the grinding disc 4 and rotatable support 8 and in the grinding disc 6 and carrying plate 18 as generally indicated in FIG. 1. This cavity 38 is formed between the grinding discs 4 and 6 to receive the material to be ground by the discs. Material is supplied to the cavity 38 by way of a passage 40 formed in the carrying plate 18 and leading from the top of the carrying plate 18 to the cavity 38. An opening 42 is also formed in the top of the yoke 20 to be in alignment and communicate with the passage 40 to enable introducing the material to be ground into the opening 42 so that is passes into the passage 40 and then into the cavity 38.

Material received into the cavity 38 is caused by the rotation of the rotatable grinding disc 4 to be thrown outwardly from the center of the grinding discs to be cut and ground as hereafter described.

It is desirable to prevent ground material from entering and lodging between the yoke 20 and the grinding disc 6 and carrying plate 18. To prevent this from occurring, a groove 44 is circumferentially formed in the exterior wall of the carrying plate 18 and a resilient 0-ring 46 is placed in the groove 44 to generally circumscribe the plate 18 and the grinding disc 6 and to contact the peripheral wall of the yoke 20 formed by the opening 22. The 0-ring 46 thus prevents ground material from entering the space between the yoke 20 and grinding disc 6 and carrying plate 18. The 0-ring 46 also serves to properly center the grinding disc 6 relative to the rotatable grinding disc 4. That is, the 0-ring 46 serves to guide the axial movement of the grinding disc 6.

Figure 3:
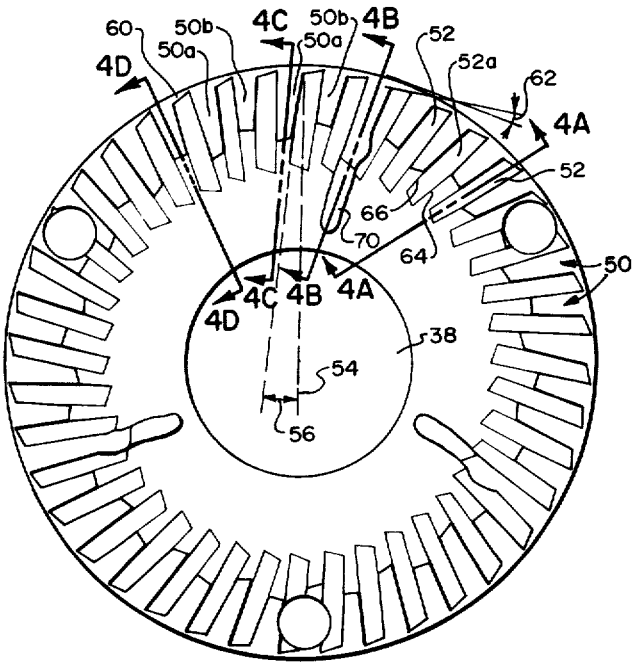
FIG. 3 is a front elevational view of the cutting face of a grinding disc made in accordance with the present invention.

Referring now to FIG. 3 and composite FIG. 4, there is shown the cutting face of a grinding disc made in accordance with the principles of the present invention. The cutting face of the disc includes a plurality of cutting teeth 50 circumferentially spaced about the cutting disc and extending from near the periphery thereof generally inwardly. Every other cutting tooth **50*a* extends inwardly a greater distance than the remaining teeth 50*b* as generally shown in FIG. 3. The spacing of the teeth 50 define a plurality of channels 52 therebetween. The channels 52** similarly extend from near the periphery of the disc inwardly.

Figure 5A:
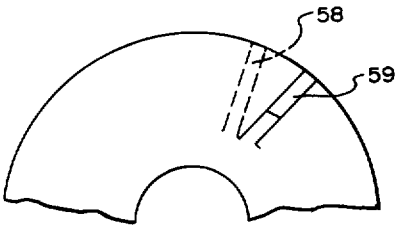
FIGS. 5A, 5B and 5C diagrammatically illustrate the scissor action of the cutting teeth of grinding discs.
Figure 5B:
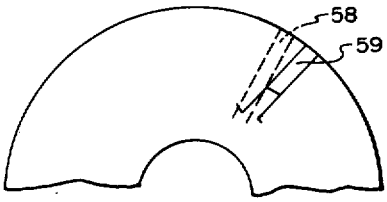
Figure 5C:
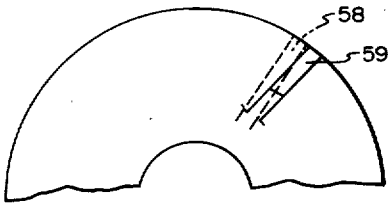

As can be seen from FIG. 3, the cutting teeth 50 and channels 52 extend at an angle to the radii of the disc rather than directly toward the center 54 of the disc. Advantageously, this angle, represented by the double arrows 56, is about 5 degrees. By forming the cutting teeth 50 in channels 52 at the indicated angle, and by rotating one disc in the appropriate direction relative to the other, a scissor action between the cutting teeth of the discs is effected (the angle between the cutting teeth advantageously being about 10°). Thus, if the cutting face of a disc similar to that shown in FIG. 3 were positioned to face the cutting face of the disc of FIG. 3 and then rotated in the clockwise direction, it is apparent that a kind of scissor action between the teeth of the corresponding discs would be effected. Further, this scissor action would tend to operate outwardly from the center of the discs. That is, the scissor-like closure of each pair of teeth between the discs would tend to force the material being cut or ground outwardly. This is illustrated in composite FIG. 5 which shows a tooth 59 of a stationary disc and a tooth 58 (shown in dotted line) of a disc being rotated in the clockwise direction. The scissor action between the teeth 59 and 58 is apparent from the sequence of positions shown in composite FIG. 5.

The outer margin of the cutting face of the disc of FIG. 3 is formed into a generally circular plane surface 60 which circumscribes the cutting teeth 50 and channels 52. This plane surface is coplanar and merges with the top surfaces of the cutting teeth 50, which top surfaces are generally flat as shown in FIGS. 4C and 4D which respectively show a longer cutting tooth and a shorter cutting tooth. Advantageously the length of the flat top surfaces of longer cutting teeth is about .450 inch and the length of the flat top surfaces of the shorter teeth is about 0.400 inch. The circular plane surface 60 is provided to enable control of the grade and size of ground material, i.e., to hold back material from exiting from between the discs until it has been reduced to the desired size. This will be discussed further later in the description.

The channels 52, as indicated earlier, extend from near the periphery of the disc, and specifically from the marginal circular plane surface 60, inwardly. The outer end of each channel terminates in the marginal plane surface at an angle to the tangent ofthe periphery of the disc, this angle being indicated by the double arrows 62. Advantageously, this angle is about 5°. The angle is formed by planing one side of the bottom wall of each channel deeper than the other side. For example, side 64 of channel **52*a* is planed deeper into the face of the disc than side 66 to thereby form the angle between the termination of the channel and the tangent to the disc as indicated in FIG. 3. The distance from the termination of the channel to the disc periphery, i.e., the (narrowest) width of the marginal plane surface 60**, is about 0.020 inch.

Figure 4A:
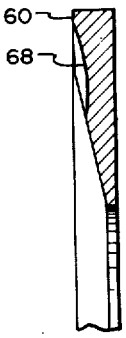
FIGS. 4A, 4B, 4C and 4D are views taken along lines 4A-4A, 4B-4B, 4C-4C and 4D-4D respectively of FIG. 3.

As best seen in FIG. 4A, the bottom wall 68 of each channel 52 is generally concave in its lengthwise direction and the channels decrease in depth toward the periphery of the disc. Advantageously, the width of the channels 52 is about 0.125 inch.

The illustrative dimensions of the parts of the discs are proportioned so as to facilitate cutting the material introduced between the discs. A proportionate increase or decrease of the dimensions would respectively increase or decrease cutting capacity and also respectively increase or decrease the horsepower requirements to drive the rotatable grinding disc.

Figure 4B:
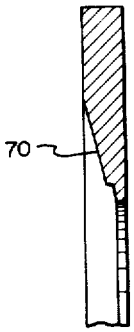
Figure 4C:
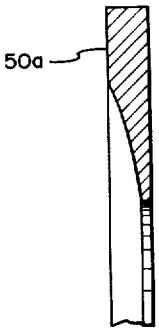
Figure 4D:
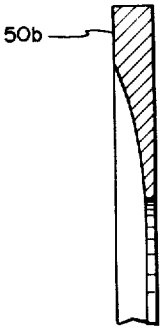

Extending inwardly from the inner ends of selected ones of the long cutting teeth 50*a* are cracking teeth 70. Advantageously, three of such cracking teeth 70 are provided in the cutting face of the disc and are evenly spaced apart between the cutting teeth to which they are joined and the central cavity 38 previously discussed. A side cross-sectional view of such cracking teeth 70 is shown in FIG. 4B. The cracking teeth 70 also extend inwardly at an angle to the radii of the disc to effect a type of scissor action to crack large kernels of material introduced between grinding discs. Advantageously the length of the flat top surfaces of the cracking teeth 70 is about 0.535 inch. A brief description of the operation of the grinding discs will now be described.

Material to be ground, such as wheat, soybeans, rice, etc., is introduced into the grinding mill of FIG. 1 through the opening 42 in the yoke 20 and through the passage 40 in the carrying plate 18 into the hollow or cavity 38 between the grinding discs 4 and 6. The rotation of grinding disc 4 forces the material outwardly from the center of the discs first to be ground and cracked by cracking teeth 70. The cracking teeth 70 tend to break the kernels of material into smaller kernels by a scissor action between the cracking teeth. This scissor action operates outwardly, as previously described, to force the material outwardly toward the cutting teeth 50. The material is forced outwardly through the channels 52 and while moving through the channels is cut finer and finer by the scissor action of the cutting teeth 50. The longer cutting teeth 50*a*, since they extend inwardly further than the shorter cutting teeth 50*b*, operate to trap the material against one side of each such tooth to begin forcing the migration of the material outwardly through the channel on the one side. Since the channels decrease in depth toward the periphery of the disc, as the material moves outwardly, the exposure of the material to the cutting teeth increases and thus the material is cut finer and finer as it moves outwardly through the channels. The material generally moves through the channels along the sides which are cut deeper into the discs, e.g., side 64 of channel 52*a*. Ultimately, the material moves into that part of the channels 52 where the channels merge with the marginal circular plane 60 and then is thrown outwardly through the separation between the cutting faces. By varying the separation between the cutting faces and in particular between the plane surfaces 60, the grade and size of the ground material may be controlled. Of course, a small separation of the plane surfaces 60 would result in finely ground material while a large separation would result in more coarsely ground material. The concavity of the bottom wall of the channels serves to retard the outward movement of the material so that it is subject to more complete cutting by the cutting teeth and this results in reducing the chance of the material getting clogged in the cutting faces.

Because the material to be ground is cut rather than crushed, less heat is generated in the grinding process and thus an otherwise adverse effect on the ground material is avoided.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A grinding mill for grinding grains and the like comprising a pair of substantially coaxially disposed discs, each having a cutting face arranged in adjacent and opposing relationship with the cutting face of the other disc, each of said cutting faces including a plurality of circumferentially spaced cutting teeth defining channels therebetween, said teeth and channels extending from near the peripheries of the discs inwardly at an angle to the radii of the discs to effect an outwardly operating scissor action between the teeth of opposing cutting faces as one disc is rotated relative to the other, every other of said cutting teeth extending inwardly a greater distance than the remaining teeth, said discs being formed to define a central cavity between the discs to receive material to be ground, means for introducing material to be ground into said cavity, and means for rotating one of said discs relative to the other to thereby cut material introduced into the cavity and force the cut material outwardly through the channels in the cutting faces.

2. A grinding mill as in claim 1 wherein said angle to the radii is substantially five degrees.

3. A grinding mill as in claim 1 wherein the width of said channels is substantially 0.125 inch.

4. A grinding mill as in claim 1 wherein at least portions of the tops of the cutting teeth of each cutting face are flat to generally define a common plane and wherein the flat portion of the top of every other tooth of each cutting face extends inwardly a greater distance than the flat portion of the tops of the remaining teeth.

5. A grinding mill as in claim 4 wherein the length of the flat portions of the tops of said every other tooth is substantially 0.450 inch.

6. A grinding mill as in claim 5 wherein the length of the flat portions of the tops of said remaining teeth is substantially 0.400 inch.

7. A grinding mill as in claim 4 wherein the channels decrease in depth outwardly toward the peripheries of the discs.

8. A grinding mill as in claim 7 wherein the outer margin of each cutting face is formed into a generally circular plane surface which is coplanar and merges with the flat portions of the tops of the corresponding cutting teeth.

9. A grinding mill as in claim 8 wherein one side of the bottom wall of each channel extends into the marginal circular plane surface a greater distance than the other side thereof.

10. A grinding mill as in claim 8 wherein the outer end of each channel terminates in the marginal circular plane surface at an angle to the tangent of the periphery of the corresponding disc.

11. A grinding mill as in claim 10 wherein said angle to the tangent is substantially five degrees.

12. A grinding mill as in claim 8 wherein the bottom walls of said channels are concave in the lengthwise direction.

13. A grinding mill as in claim 1 wherein each of said cutting faces further includes a plurality of cracking teeth substantially fewer in number than the cutting teeth and spaced apart between the corresponding cutting teeth and central cavity, said cracking teeth of one cutting face cooperating with the cracking teeth of the other cutting face to crack material to be ground as one disc is rotated relative to the other.

14. A grinding mill as in claim 13 wherein each cracking tooth extends inwardly from the inner end of a different cutting tooth.

15. A grinding mill as in claim 1 further comprising means for moving one disc axially with respect to the other disc, and means for preventing movement of said movable disc into contact with the other disc.

16. A grinding mill as in claim 15 wherein said preventing means is adjustable to vary the distance to within which the movable disc may be moved toward the other disc.

17. A grinding mill as in claim 16 wherein said moving means comprises a stationary support disposed behind the movable disc and having a bore extending therethrough, and carrying means on which is mounted the movable disc and which is movable with respect to said stationary mount, and wherein said preventing means comprises a threaded post extending from said carrying means through the bore in the support, and a lock nut for screwing onto said post to contact said support when the carrying means and thus the movable disc are moved away from the support a certain distance, to thereby prevent the movable disc from contacting the other disc.

18. A grinding mill comprising a pair of grinding discs, each having a cutting face arranged in opposing relationship with the cutting face of the other disc, one of said discs being rotatable with respect to the other disc, means for moving one disc axially with respect to the other disc, said moving means including a stationary support disposed behind the movable disc, and carrying means on which is mounted the movable disc and which is movable with respect to the stationary support, said stationary support having a bore extending therethrough, and means for preventing movement of said movable disc into contact with the other disc, said preventing means including a post extending from the carrying means through the bore in the stationary support, and stop means mountable on said post to engage the support when the carrying means is moved to a certain determinable distance away from the support, to thereby prevent the movable disc from contacting the other disc.

19. A grinding mill as in claim 18 wherein said post is threaded and wherein said stop means comprises a lock nut which is screwable onto the threaded post.

* * * * *